US008955929B2

(12) United States Patent
Holzapfel et al.

(10) Patent No.: US 8,955,929 B2
(45) Date of Patent: Feb. 17, 2015

(54) CATCHING LOCKING MECHANISM FOR PIECES OF FURNITURE

(71) Applicant: Julius Blum GmbH, Hochst (AT)

(72) Inventors: Andreas Holzapfel, Bregenz (AT); Benjamin Hoffmann, Dornbirn (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 14/084,943

(22) Filed: Nov. 20, 2013

(65) Prior Publication Data

US 2014/0077678 A1 Mar. 20, 2014

Related U.S. Application Data

(63) Continuation of application No. PCT/AT2012/000128, filed on May 7, 2012.

(30) Foreign Application Priority Data

May 24, 2011 (AT) ..... 752/2011

(51) Int. Cl.
*A47B 88/00* (2006.01)

(52) U.S. Cl.
CPC ..... *A47B 88/0055* (2013.01); *A47B 88/0051* (2013.01)
USPC ..... 312/348.4; 312/265.5

(58) Field of Classification Search
CPC ..... A47B 88/00; A47B 88/0055; A47B 88/0044; A47B 88/0051
USPC ..... 312/348.4, 348.1, 265.5, 265.6, 330.1
See application file for complete search history.

(56) References Cited

U.S. PATENT DOCUMENTS

| | | | | |
|---|---|---|---|---|
| 3,540,509 | A | 11/1970 | Gutshall | |
| 4,846,538 | A * | 7/1989 | Rock et al. | 312/263 |
| 5,463,891 | A | 11/1995 | Hasegawa | |
| 5,540,515 | A * | 7/1996 | Rock et al. | 403/322.4 |
| 5,664,857 | A * | 9/1997 | Lautenschlager et al. | 312/348.4 |
| 5,688,033 | A * | 11/1997 | Fleisch et al. | 312/348.4 |
| 5,860,718 | A * | 1/1999 | Brustle | 312/348.2 |
| 5,895,103 | A * | 4/1999 | Huber | 312/348.4 |
| 7,055,919 | B2 * | 6/2006 | Lam Harn et al. | 312/348.4 |
| 7,429,090 | B2 * | 9/2008 | Salice | 312/348.4 |
| 8,262,175 | B2 * | 9/2012 | Lam et al. | 312/348.4 |

(Continued)

FOREIGN PATENT DOCUMENTS

| | | |
|---|---|---|
| DE | 44 14 966 | 11/1995 |
| DE | 20 2004 006 648 | 8/2004 |

(Continued)

OTHER PUBLICATIONS

International Search Report issued Sep. 12, 2012 in International (PCT) Application No. PCT/AT2012/000128.

(Continued)

*Primary Examiner* — Daniel Rohrhoff
(74) *Attorney, Agent, or Firm* — Wenderoth, Lind & Ponack, L.L.P.

(57) ABSTRACT

A catching locking mechanism for pieces of furniture, including an adjustable wheel that has a catching structure in at least some areas, and a mating catch that cooperates with the catching structure of the adjustable wheel. The mating catch is made of a sheet metal part, and is designed to be resilient, preferably in the form of a springy tongue.

20 Claims, 6 Drawing Sheets

(56) References Cited

U.S. PATENT DOCUMENTS

| | | | | |
|---|---|---|---|---|
| 8,727,461 | B2 * | 5/2014 | Holzapfel et al. | 312/348.4 |
| 2013/0154463 | A1 * | 6/2013 | Henscheid et al. | 312/330.1 |
| 2014/0070687 | A1 * | 3/2014 | Holzapfel et al. | 312/348.4 |
| 2014/0077678 | A1 * | 3/2014 | Holzapfel et al. | 312/348.4 |

FOREIGN PATENT DOCUMENTS

| | | |
|---|---|---|
| DE | 10 2007 053 637 | 5/2009 |
| EP | 0 740 917 | 11/1996 |
| GB | 1 282 748 | 7/1972 |
| WO | 96/28995 | 9/1996 |
| WO | 2009/059652 | 5/2009 |

OTHER PUBLICATIONS

Austrian Search Report issued Dec. 15, 2011 in Austrian Patent Application No. A 752/2011 with translation.

* cited by examiner

CATCHING LOCKING MECHANISM FOR PIECES OF FURNITURE

BACKGROUND

The invention relates to a catching locking mechanism for pieces of furniture, comprising an adjustment wheel which has a catch structure at least in some regions, and a mating catch which cooperates with the catch structure of the adjustment wheel, wherein the mating catch essentially consists of a sheet-metal part. The invention further relates to a piece of furniture having a catching locking mechanism according to the invention.

Catching locking mechanisms are normally used to hold a component fast in a particular position by means of a force-fitting and/or form-fitting connection. In the case of pieces of furniture, catching locking mechanisms are used in various areas.

For example, the specification of German utility model DE 20 2004 006 648 U1 provides a catching locking mechanism in combination with a cam, which makes it possible to perform a stepwise vertical adjustment of a front fitting that holds the front wall of a drawer. The catching locking mechanism is arranged in one of the side walls of the drawer. The stepwise vertical adjustment is performed in that an adjustment wheel abuts flat against a base panel comprising protuberances.

The specification of German unexamined patent application DE 44 14 966 A1 discloses a catching locking mechanism which essentially consists of a U-shaped metal part, wherein a locking mechanism shaft is arranged between the limbs of this U shape. The mating catch is formed by teeth which are arranged along the inner flank of a circular depression.

It is disadvantageous that the catching locking mechanisms for pieces of furniture that form part of the state of the art have an overall height which, seen in cross section, is relatively large as a result of their often complex design. If it is desired to arrange a catching locking mechanism of this kind inside a side wall of a drawer, this circumstance has the further consequence that the drawer side wall has to be relatively thick.

However, in recent years there has been an increasing demand for furniture, for example in the kitchen sector, which is characterized by a material that is as elegant as possible and by a space-saving design. The catching locking mechanisms known hitherto have proved to be a hindrance to meeting this customer preference.

SUMMARY

The object of the present invention is to avoid the disadvantages described above and to specify a catching locking mechanism for pieces of furniture which improves on the state of the art and which is characterized in particular by a simple and space-saving design.

The term "sheet metal" is used to designate a finished rolling product which essentially consists of metal, preferably steel. Sheet metals are characterized, in the context of the invention, primarily in that they are formed flat and have a high degree of rigidity, for example by comparison with plastic. Moreover, they can be worked relatively easily. Therefore, from the point of view of manufacturing technology, it is also advantageous if the sheet-metal part, of which the mating catch essentially consists, is a punched sheet-metal part.

Because the mating catch is formed inherently resilient, the adjustment wheel can be adjusted relatively easily. This property can be realized from a technical viewpoint for example in that the mating catch is formed as a flexible (spring) tongue.

If, for particular applications, it is desired to increase the spring constant of this spring, a flexible tongue mounted on both sides is advantageously used.

A particularly flat and space-saving design can be realized in that the catch structure is arranged on the periphery of the adjustment wheel. In the case of a wheel used for the purposes of an advancing movement, this region of the wheel would be designated as the rolling face. If the adjustment wheel is cylindrical, the catch structure is arranged on the outer casing. If the plane of the sheet-metal part forming the mating catch is moreover also oriented substantially perpendicular to the axis of rotation of the adjustment wheel, then the arrangement comprising the adjustment wheel and the mating catch has an overall height, as seen in cross section, which is substantially determined by the overall height of the adjustment wheel.

A very simple and hence inexpensive design of the catching locking mechanism is characterized in that the mount for the adjustment wheel is formed in the same sheet-metal part as the mating catch.

In addition to the possibilities mentioned above for varying the rigidity and/or, in the case of an embodiment in the form of a flexible tongue, the spring constant of the mating catch, these two properties can also be changed in that the mating catch has a tapering portion or thickened portion in the region in which the mating catch cooperates with the catch structure of the adjustment wheel.

Advantageously, the catch structure of the adjustment wheel has protuberances or grooves. If the catch structure is arranged on the periphery of the adjustment wheel, these protuberances or grooves thus stand out radially.

Cooperation between the mating catch and the catch structure of the adjustment wheel can be improved in that the mating catch has, at least in some regions, a latching structure that corresponds with the catch structure of the adjustment wheel.

In order to simplify the adjustment of the adjustment wheel, it can be provided that the adjustment wheel has, on one side, a depression for a tool, preferably in the form of a hexalobular socket. Naturally, a bulging shape which provides a contact surface for a tool is also conceivable. However, this would naturally protrude out of the plane of the adjustment wheel and in this way increase the overall height of the catching locking mechanism, as seen in cross section.

If it is desired to use the catching locking mechanism to adjust a first component of a piece of furniture in relation to a second component of the piece of furniture, the catching locking mechanism can be arranged between these two components, wherein advantageously the catching locking mechanism is secured to the first component and the second component is connected to the adjustment wheel. This connection can for example be realized from a technical viewpoint in that the adjustment wheel has, on one side, at least one eccentrically arranged pin or a spiral guide track or guiding groove, and on the second component of the piece of furniture there is provided a corresponding recess for the at least one eccentrically arranged pin or at least one guide element corresponding to the guide track or guiding groove. Overall, a rotary movement of the adjustment wheel is then manifested as a stepwise translational movement of the second component of the piece of furniture in relation to the first component of the piece of furniture, wherein the second component can be fixed, by interrupting the rotary movement, in any of the catch positions that it passes through stepwise.

As an example of an application there may be mentioned a drawer which comprises in particular a front wall and side walls, wherein the catching locking mechanism is arranged in at least one of the side walls for adjustment of a front fitting that holds the front wall. The catching locking mechanism preferably serves to perform a vertical adjustment of the front wall of the drawer.

BRIEF DESCRIPTION OF THE DRAWINGS

Further details and advantages of the present invention will be explained in more detail below with the help of the description of the figures, with reference to the embodiment examples represented in the drawings. The figures show.

DETAILED DESCRIPTION

Figure 1B:
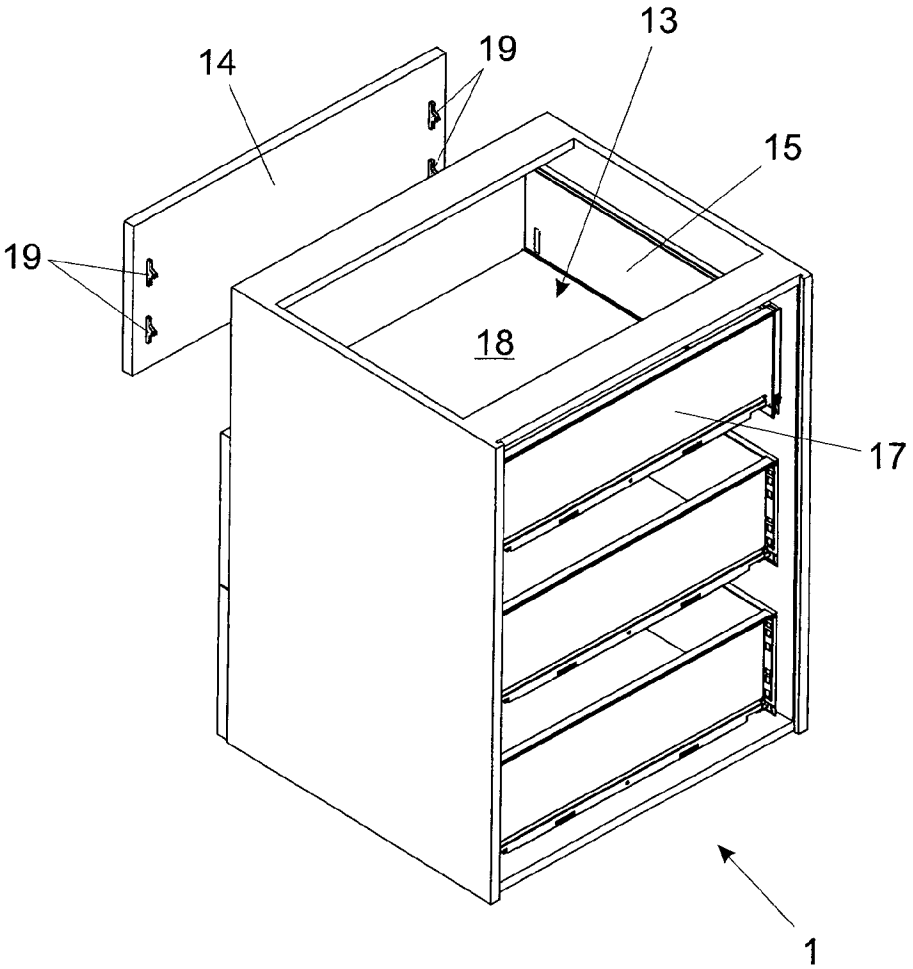
FIG. 1*b* a further perspective view of the piece of furniture seen in FIG. 1*a*, wherein the front wall has been removed from the top drawer, FIG. 2*a* a perspective view of a side wall of a drawer, FIG. 2*b* a further perspective view of the side wall seen in FIG. 2*a*, wherein only part of the side wall is represented, in order to reveal a view of FIGS. 3*a* and 3*b* two enlarged perspective views of the front fitting seen in FIG. 2*b*, from two different directions of view, FIGS. 3*c* and 3*d* two further perspective views of the front fitting seen in FIGS. 3*a* and 3*b*, wherein the front panel is omitted in FIG. 3*c* and the securing panel is omitted in FIG. 3*d*, FIGS. 3*e* and 3*f* two further perspective views of the front fitting seen in FIGS. 3*c* and 3*d*, wherein in each case only a cut-away part is represented, FIG. 4 an exploded representation of the front fitting seen in FIGS. 2*b* and 3*a* to 3*f*, in which the individual components are shown, FIG. 5 an exploded representation of a further preferred embodiment example of the front fitting, and FIG. 6 a top view of the securing panel of the front fitting seen in FIGS. 2*b* and 3*a* to 3*f*, together with the rotatably mounted adjustment wheel of the catching locking mechanism.
Figure 1A:
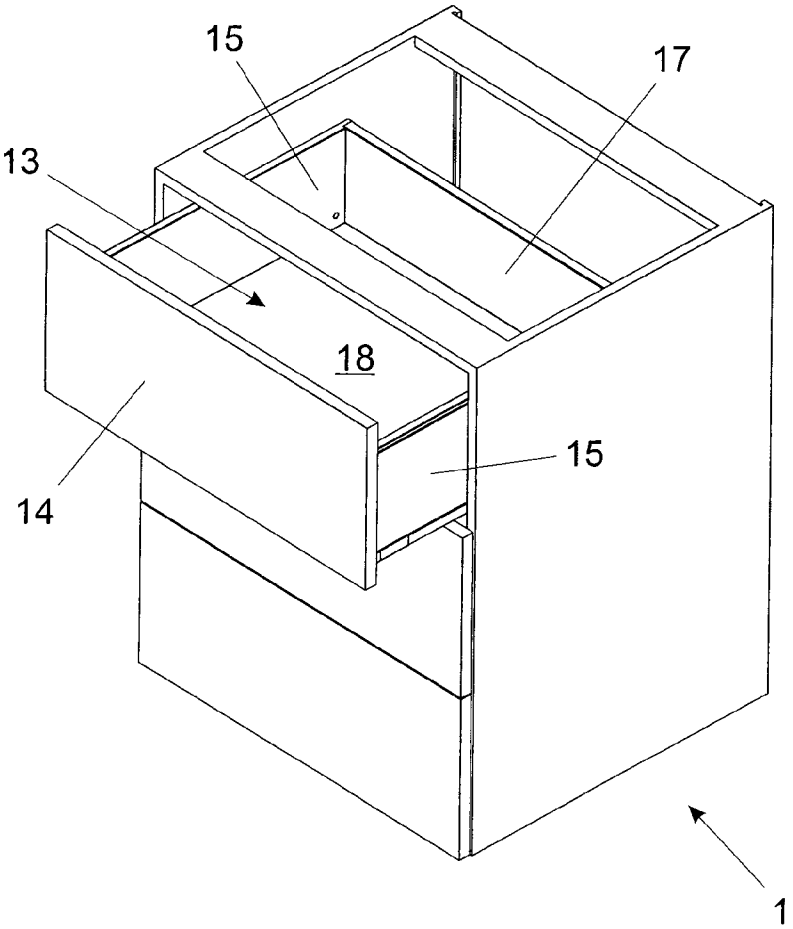
FIG. 1*a* a perspective view of a piece of furniture, with an open drawer.

FIGS. 1*a* and 1*b* show two perspective views of a piece of furniture 1 in which the catching locking mechanism has been installed. The piece of furniture 1 comprises three drawers 13, wherein the drawers 13 each essentially consist of a front wall 14, two side walls 15 and a rear wall 17, as well as a base panel 18. In each of the side walls 15 of the drawer 13 there is arranged a catching locking mechanism for adjusting a front fitting (not shown in this figure) that holds the front wall 14. The front wall 14 is releasably secured to the front fittings via a plurality of front securing means 19. FIG. 1 *b* represents a situation in which the front wall 14 has been removed from the top drawer 13.

Figure 2A:
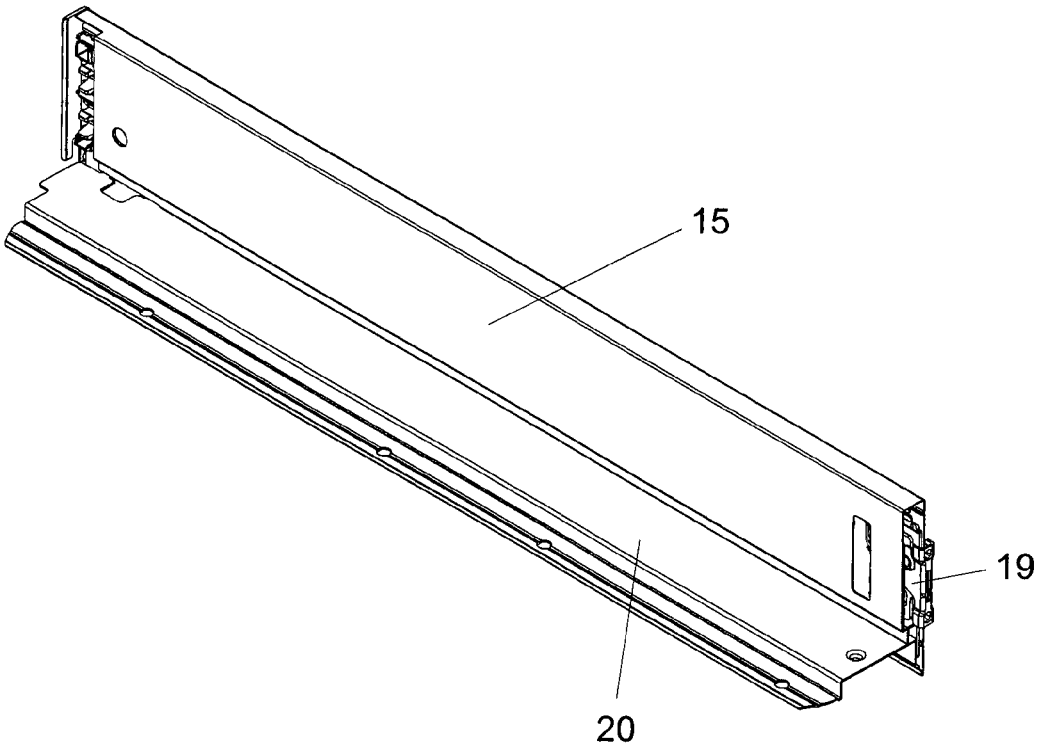
Figure 2B:
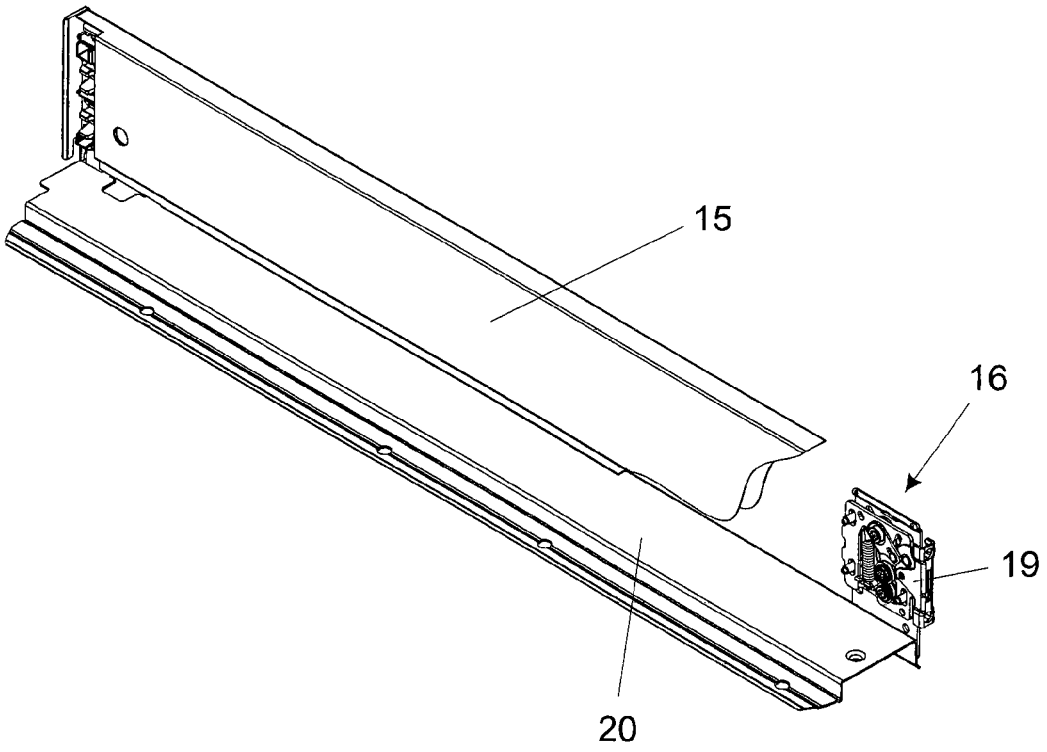

FIGS. 2*a* and 2*b* show a side wall 15 of a drawer (cf. FIGS. 1*a* and 1*b*), wherein this side wall 15 is secured to a carrier rail 20 for the base panel of the drawer. In the rear part, top left, securing devices for the rear wall of the drawer 13, which is connected perpendicularly to the side wall 15, are indicated schematically. In the front part, bottom right, the above-mentioned front fitting 16 is arranged inside the side wall 15, wherein this front fitting 16 is preferably welded to the carrier rail 20 for the base panel 18. Pinned to the front fitting 16, there is one of the front securing means 19, which is normally screwed to the front wall.

Figure 3A:
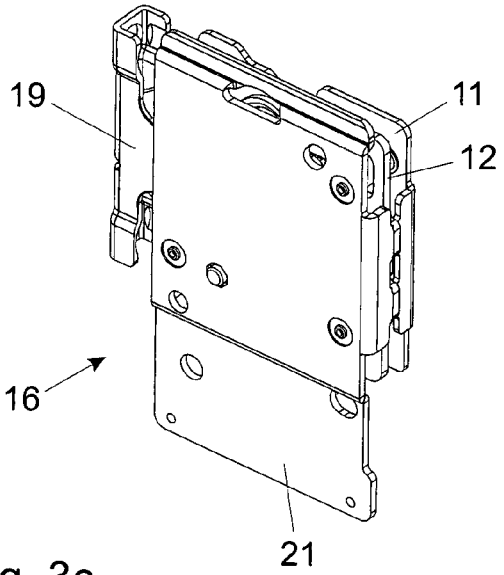
Figure 3B:
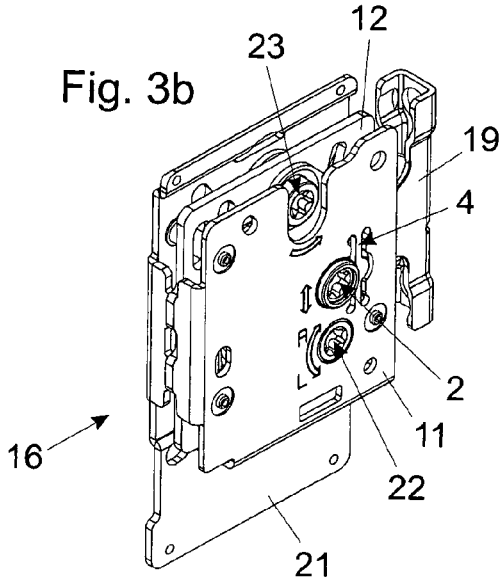

The front fitting 16 and in particular the catching locking mechanism will be explained specifically in more detail with reference to the following figures. FIGS. 3*a* and 3*b* show the front fitting 16 from two different directions of view, wherein in FIG. 3*a* the front fitting 16 is viewed from the side on which the front panel 21, with which the front fitting 16 is secured to the carrier rail for the base panel of the drawer (cf. FIGS. 2*a* and 2*b*), is located. The opposite side of the front fitting 16 is viewed in FIG. 3*b*. Roughly speaking, the front fitting 16 can be divided into three different units: the above-mentioned front panel 21, via which the front fitting 16 is connected to the carrier rail; a vertical adjustment panel 12 which is connected to the front wall of the drawer; and, finally, a securing panel 11. The vertical adjustment panel 12 is arranged between the front panel 21 and the securing panel 11. The front fitting 16 essentially fulfils three functions: first, it serves to provide a releasable way of securing the front wall of the drawer. To this end, a securing mechanism composed among other things of a plurality of levers 24, 24', 25, 25', a spring 29 and an unlocking screw 23 is attached to the vertical adjustment panel 12. The second function of the front fitting 16 consists in providing the possibility of lateral adjustment. To this end there serves, essentially, the lateral adjustment screw 22 seen in FIG. 3*b*, wherein rotation of this lateral adjustment screw 22 results in the vertical adjustment panel 12 being moved closer to the securing panel 11 or the front panel 21. Finally, the vertical adjustment panel 12 can also (as the third function of the front fitting 16) be moved upward or downward with the aid of the catching locking mechanism. Further details will not be given about the first two of these named functions, since these functions have nothing to do with the present invention.

Figure 3C:
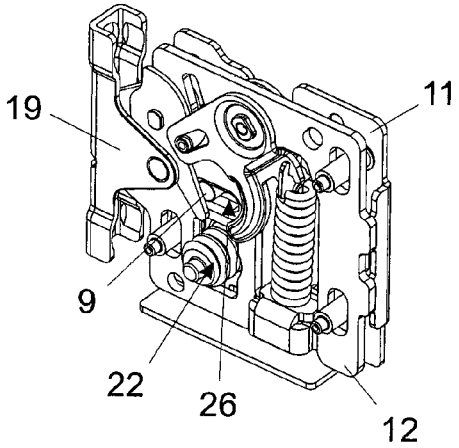
Figure 3D:
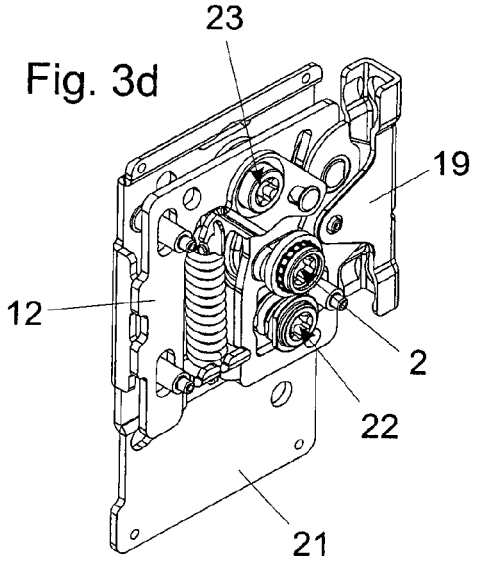
Figure 3E:
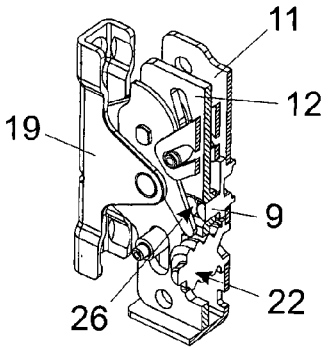
Figure 3F:
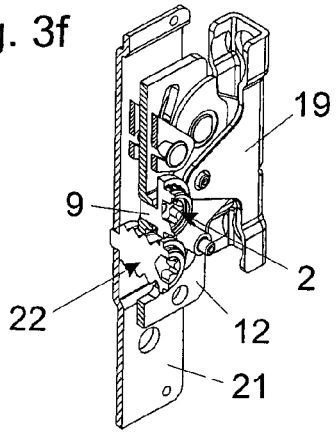

The two groups of FIGS. 3*c* and 3*d* as well as 3*e* and 3*f* each show two further views of the front fitting 16 seen in FIGS. 3*a* and 3*b*, wherein the front panel 21 is omitted in FIG. 3*c* and the securing panel 11 is omitted in FIG. 3*d*, in order to reveal a view of the vertical adjustment panel 12 behind them and the components arranged on it. In FIGS. 3*e* and 3*f*, a cut-away part of the front fitting 16 seen in FIGS. 3*c* and 3*d* is represented in each case. The representation of this cut-away part in each case makes possible a relevant cross sectional view.

In the preferred embodiment example represented here, the catching locking mechanism comprises an adjustment wheel 2, which has a catch structure on some regions of its periphery, and a mating catch 4 that cooperates with the catch structure of the adjustment wheel 2. In this case, the mating catch 4 consists of a punched sheet-metal part and is formed as a flexible tongue. This flexible tongue is mounted on both sides and is formed in the same sheet-metal part in which the mount for the adjustment wheel 2 is located. The plane of the sheet-metal part forming the mating catch 4 is oriented substantially perpendicular to the axis of rotation of the adjustment wheel 2. In this way, a very flat design of the catching locking mechanism is achieved. The sheet-metal part, which comprises both the mount for the adjustment wheel 2 and the mating catch 4, is the securing panel 11. On one side the adjustment wheel 2 has an eccentrically arranged pin 9 which projects into a corresponding recess 26 located in the vertical adjustment panel 12. Thus, a rotary movement of the adjustment wheel 2 results in a stepwise translational movement of the vertical adjustment panel 12 in relation to the securing panel 11 and in relation to the front panel 21.

Figure 4:
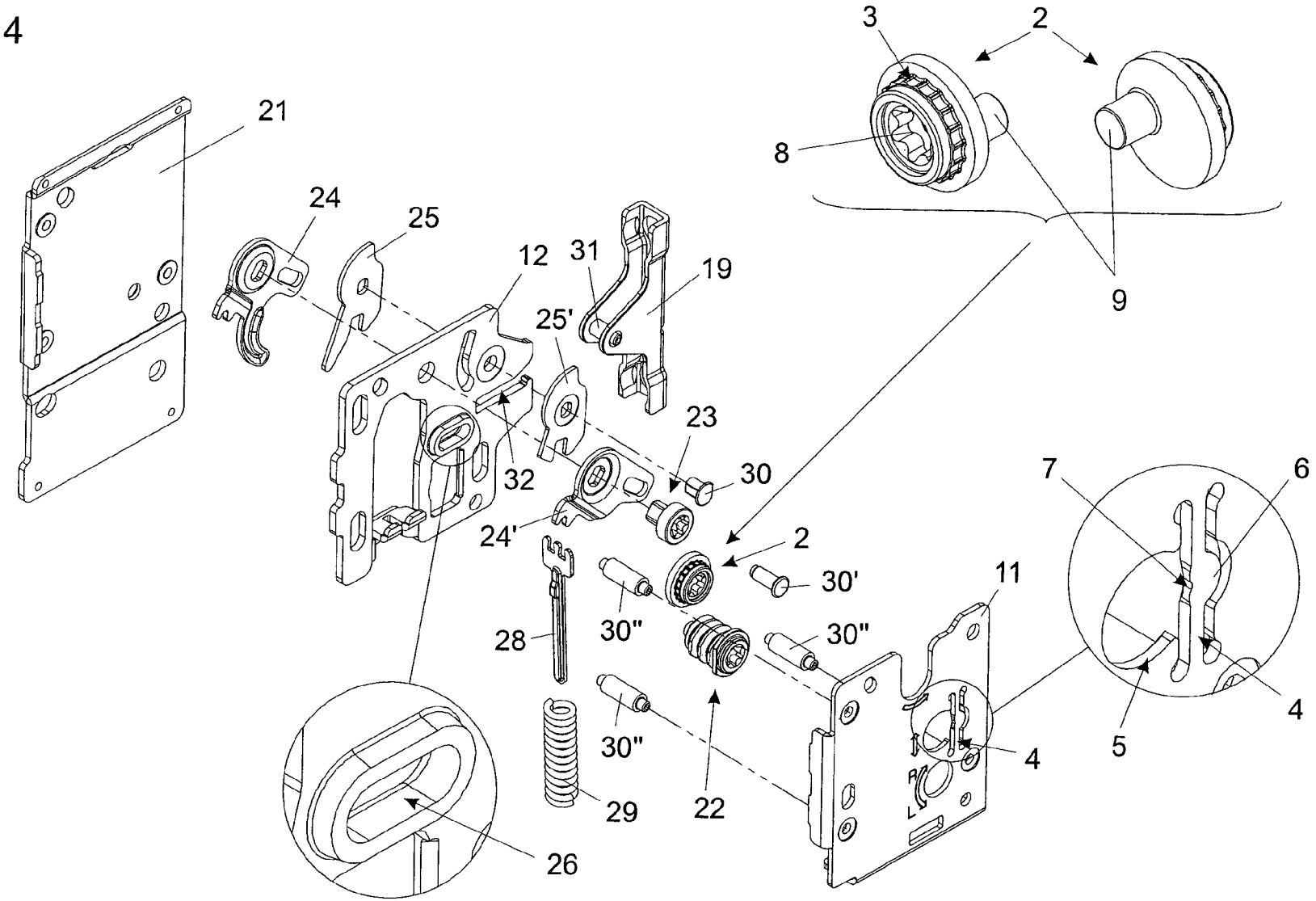

FIG. 4 shows an exploded representation of the front fitting seen in FIGS. 2*b* and 3*a* to 3*f*. In the preferred embodiment represented, the front fitting specifically comprises (from top left to bottom right) the following components:

- a front panel 21 via which the entire front fitting is secured to the carrier rail for the base panel (cf. FIGS. 2*a* and 2*b*);
- a group of components which is needed for the securing or release safeguard mechanism for the front wall of the drawer. These include an adjustment lever, consisting of two parts, 24 and 24'; a tilt lever, consisting of two parts, 25 and 25'; an unlocking screw 23; a rivet 30 for securing the tilt lever 25, 25' to the vertical adjustment panel 12; a pressure roller 30' which is needed for controlled rotary movement of the adjustment lever 24, 24' in relation to the vertical adjustment panel 12; and a spring-loaded device which consists of a spring receiver 28 and a spring 29. To secure the front wall of the drawer, a front securing means 19 is first screwed to the front wall. This front securing means 19 comprises among other things a transverse pin 31, and this pin 31 can be pushed into a suitably shaped slot 32 located in the vertical adjustment panel 12 and locked there (such that it can be unlocked again);

the adjustment wheel 2 of the catching locking mechanism;

the lateral adjustment screw 22 described above, for lateral adjustment of the vertical adjustment panel 12;

a plurality of spacers 30" which serve to hold the entire construction together and/or to keep the front panel 21 and the securing panel 11 at a particular distance from one another; and finally the securing panel 11, which comprises among other things the mount 5 for the adjustment wheel 2 and the mating catch 4 (in the form of a flexible tongue mounted on both sides).

The components that have relevance for the catching locking mechanism are each represented enlarged in this FIG. 4. These include—as already mentioned—the corresponding recess 26, arranged in the vertical adjustment panel 12, for the pin 9 that is arranged eccentrically on one side of the adjustment wheel 2; the adjustment wheel 2, which has a catch structure 3 on some regions of its periphery; and the inherently resilient mating catch 4. In the preferred embodiment represented here, the adjustment wheel 2 has a hexalobular socket 8 on the opposite side to the side with the eccentrically arranged pin 9, via which hexalobular socket 8 the adjustment wheel 2 can be adjusted with the aid of a suitable tool. The mating catch 4 has in the centre a latching structure 7 that corresponds with the catch structure 3 of the adjustment wheel 2, and has a thickened portion 6 in those regions in which the mating catch 4 cooperates with the catch structure 3 of the adjustment wheel 2.

Figure 5:
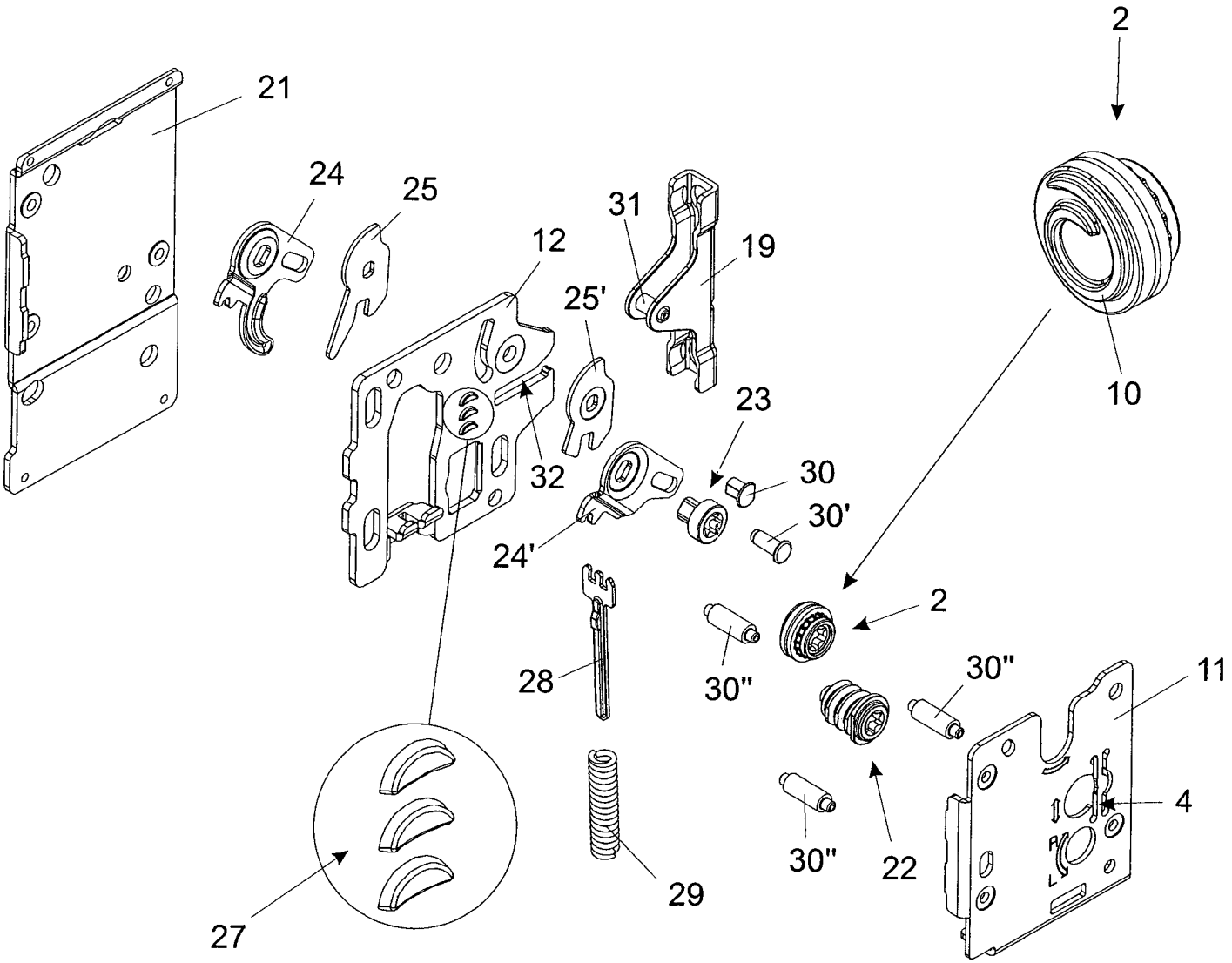

FIG. 5 shows an exploded representation of a second preferred embodiment example of the front fitting. The difference from the embodiment example represented in FIG. 4 is that the adjustment wheel 2 is not connected to the vertical adjustment panel 12 via an eccentrically arranged pin and a corresponding recess but via a spiral guide track 10, which cooperates with three semicircular guide elements 27 that are arranged laterally on the vertical adjustment panel 12. Rotation of the adjustment wheel 2 has the result that the adjustment wheel 2 moves stepwise up or down from one of these guide elements 27 to the next.

Figure 6:
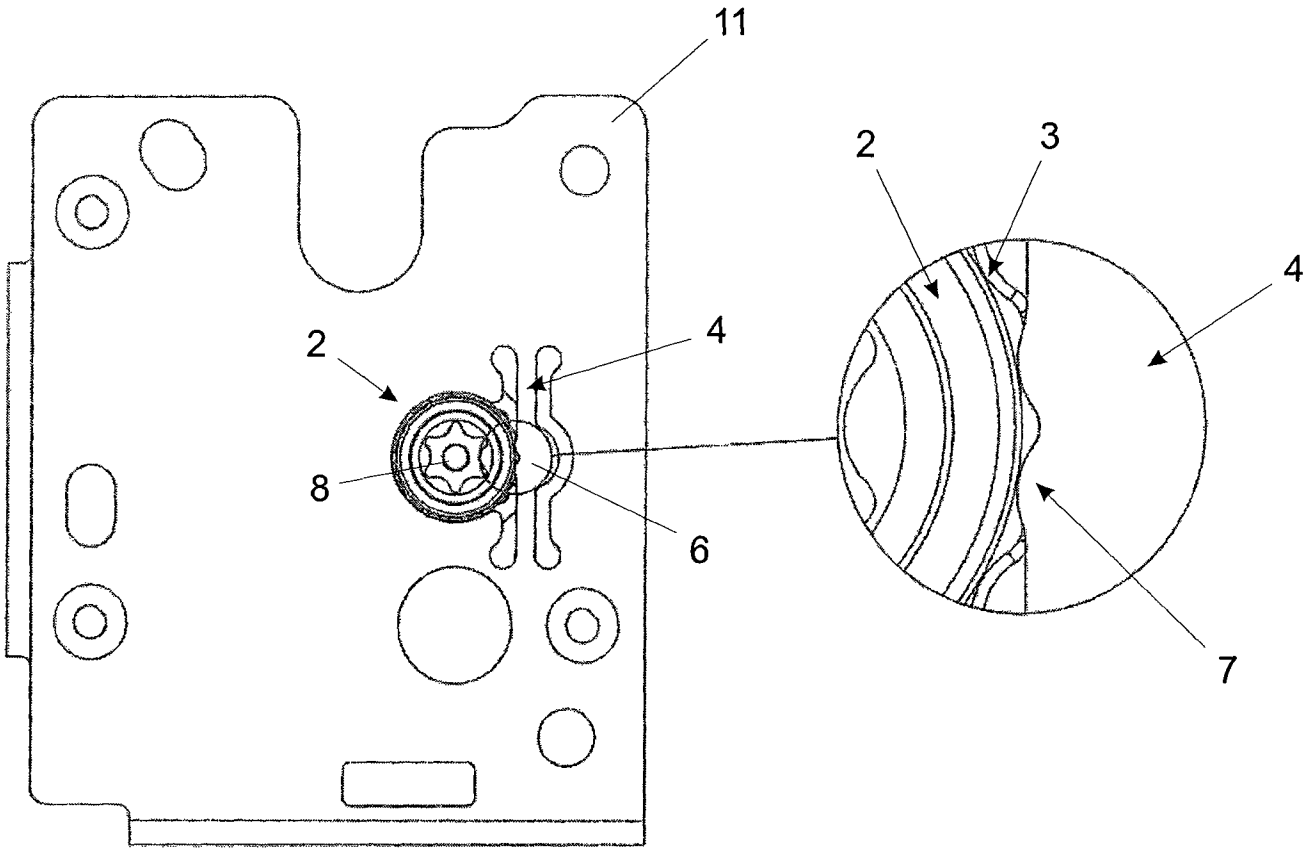

Finally, FIG. 6 shows a top view of the securing panel 11 of the front fitting seen in FIGS. 2*b* and 3*a* to 3*f*, together with the rotatably mounted adjustment wheel 2 of the catching locking mechanism. In the enlarged section, it is clear that the catch structure 3 of the adjustment wheel 2 fits precisely into the corresponding latching structure 7 of the mating catch 4, and thus cooperates therewith.

LIST OF REFERENCE NUMBERS

1 Piece of furniture
2 Adjustment wheel
3 Catch structure
4 Mating catch
5 Mount for the adjustment wheel
6 Thickened portion
7 Latching structure
8 Depression for a tool (hexalobular socket)
9 Eccentrically arranged pin
10 Spiral guide track
11 Securing panel
12 Vertical adjustment panel
13 Drawer
14 Front wall
15 Side wall
16 Front fitting
17 Rear wall
18 Base panel
19 Front securing means
20 Carrier rail for base panel
21 Front panel
22 Lateral adjustment screw
23 Unlocking screw
24 and 24' Adjustment lever
25 and 25' Tilt lever
26 Recess for eccentrically arranged pin
27 Guide elements for spiral guide track
28 Spring receiver
29 Spring
30 Rivet
30' Pressure roller
30" Spacers
31 Pin
32 Slot

The invention claimed is:

1. A piece of furniture comprising:

a first component;

a second component;

a catching locking mechanism connected to the first component and the second component and comprising an adjustment wheel and a mating catch, wherein the adjustment wheel has a catch structure at least in some regions of the adjustment wheel, and the mating catch is made of a resilient sheet-metal part and includes a latch structure that engages the catch structure of the adjustment wheel at one of plural catch positions such that rotary movement of the adjustment wheel causes engagement of the latch structure of the mating catch and the catch structure of the adjustment wheel to release, and the latch structure to engage with the catch structure at a next of the plural catch positions, causing a stepwise translational movement of the second component in relation to the first component, and wherein the second component is fixed in position relative to the first component by the engagement of the latch structure of the mating catch with the catch structure of the adjustment wheel at any of the plural catch positions.

2. The piece of furniture according to claim 1, wherein the piece of furniture comprises at least one drawer having a front wall and side walls, wherein one of the side walls is said first component, and the front wall is said second component.

3. The piece of furniture according to claim 2, wherein the catching locking mechanism is arranged in at least one of the side walls of the drawer for adjustment of a front fitting that holds the front wall.

4. The piece of furniture according to claim 1, wherein the mating catch is formed as a flexible tongue.

5. The piece of furniture according to claim 1, wherein the sheet-metal part is a punched sheet-metal part.

6. The piece of furniture according to claim 1, wherein the mating catch is formed as a flexible tongue, which is mounted on both sides.

7. The piece of furniture according to claim 1, wherein the catch structure is arranged on the periphery of the adjustment wheel.

8. The piece of furniture according to claim 1, wherein the plane of the sheet-metal part of the mating catch is oriented substantially perpendicular to the axis of rotation of the adjustment wheel.

9. The piece of furniture according to claim 1, wherein a mount for the adjustment wheel is formed in the sheet-metal part of the mating catch.

10. The piece of furniture according to claim 1, wherein the mating catch has a thickened portion in a region in which the mating catch cooperates with the catch structure of the adjustment wheel.

11. The piece of furniture according to claim 1, wherein the catch structure of the adjustment wheel has protuberances or grooves.

12. The piece of furniture according to claim 1, wherein the mating catch has, at least in some regions, a latching structure that corresponds with the catch structure of the adjustment wheel.

13. The piece of furniture according to claim 1, wherein the adjustment wheel has, on one side, a depression for a tool for adjustment of the adjustment wheel.

14. The piece of furniture according to claim 13, wherein the depression is formed in the form of a hexalobular socket.

15. The piece of furniture according to claim 1, wherein the adjustment wheel has, on one side, at least one eccentrically arranged pin.

16. The piece of furniture according to claim 1, wherein the adjustment wheel has, on one side, a spiral guide track or guiding groove.

17. A catching locking mechanism for use with a piece of furniture, said catching locking mechanism comprising:

a first mounting part to be connected to a first component of the furniture;

a second mounting part to be connected to a second component of the furniture;

an adjustment wheel; and a mating catch, wherein the adjustment wheel has a catch structure at least in some regions of the adjustment wheel, and the mating catch is made of a resilient sheet-metal part and includes a latch structure that engages the catch structure of the adjustment wheel at one of plural catch positions such that rotary movement of the adjustment wheel causes engagement of the latch structure of the mating catch and the catch structure of the adjustment wheel to release, and the latch structure to engage with the catch structure at a next of the plural catch positions, causing a stepwise translational movement of the second mounting part in relation to the first mounting part, and wherein the second mounting part is fixed in position relative to the first mounting part by the engagement of the latch structure of the mating catch with the catch structure of the adjustment wheel at any of the plural catch positions.

18. The catching locking mechanism according to claim 17, wherein the mating catch is formed as a flexible tongue.

19. The catching locking mechanism according to claim 17, wherein the mating catch is formed as a flexible tongue, which is mounted on both sides.

20. The catching locking mechanism according to claim 17, wherein the catch structure is arranged on the periphery of the adjustment wheel.

* * * * *